United States Patent [19]

Bush et al.

[11] 4,298,199

[45] Nov. 3, 1981

[54] GAME

[75] Inventors: Steven C. Bush, Feasterville; Robert E. Smathers, Glassboro, both of N.J.

[73] Assignee: Product Dynamics, Ltd., Levittown, Pa.

[21] Appl. No.: 50,373

[22] Filed: Jun. 20, 1979

[51] Int. Cl.[3] ..... A63F 9/00

[52] U.S. Cl. ..... 273/1 GD; 273/1 GG; 43/63

[58] Field of Search ..... 273/1 R, 1 E, 1 M, 1 GD, 273/1 GG; 46/1 R, 47; 43/63, 88

[56] References Cited

U.S. PATENT DOCUMENTS

| | | | |
|---|---|---|---|
| 85,634 | 1/1869 | Bingham | 43/63 |
| 88,526 | 3/1869 | St Ledger | 43/63 |
| 468,274 | 2/1892 | Goodson . | |
| 966,213 | 8/1910 | Jauregin | 43/63 |
| 2,107,672 | 2/1938 | Lang | 273/1 M UX |
| 2,536,585 | 1/1951 | Titus | 43/63 |
| 2,590,002 | 3/1952 | Frazier . | |
| 2,712,444 | 7/1955 | Reed | 273/1 R |
| 2,904,336 | 9/1959 | Washburn . | |
| 3,249,357 | 5/1966 | Luchsinger . | |
| 3,312,470 | 4/1967 | Ames . | |
| 3,707,289 | 12/1972 | Wicks | 273/1 R X |
| 3,918,195 | 11/1975 | Benson et al. | 43/88 X |

*Primary Examiner*—Paul E. Shapiro

*Attorney, Agent, or Firm*—Frederick A. Zoda; John J. Kane; Albert Sperry

[57] ABSTRACT

Disclosed is a game in which a game piece is suspended on a string and is preferably formed as the simulation of a bee or other insect attractable to a flower. The game piece is dangled by the player in a playing area simulating the portion of the flower bounded by the perianth. The perianth includes a series of trap elements formed in the simulation of petals and pivotally mounted on the base for swinging movement between open positions in which they expose the playing area to permit the game piece to be suspended therein, and closed positions in which they trap the game piece. In the playing area a centrally disposed trigger member has a connection to the trap elements such that on upward movement of the trigger member, the trap elements will be biased instantly to the positions in which they trap the game piece. The game piece and the trigger member, which simulates the pistil of the flower, have magnetically attractive members, which will produce the upward movement of the trigger member if the game piece moves too close to it. The object of the game is to cause the game piece to remove a plurality of counters formed in the simulation of stamens from the playing area while avoiding trapping of the game piece by the petal simulations.

15 Claims, 7 Drawing Figures

GAME

BACKGROUND OF THE INVENTION

1. Field of the Invention

The invention relates generally to amusement devices or games, and more particularly to a game in which, in a preferred embodiment, there is a simulation of a flower and a game piece suspendable therein by a player and adapted either to be magnetically attracted to a pistil-simulating portion of the flower, while also being adapted to engage and remove stamen-simulating counters. The game is properly categorized as one of skill in that the movement of the game piece is entirely under the control of the player, who is required to exercise his or her skill in keeping the game piece from the area in which it is magnetically attracted to the pistil simulation, an occurrence which causes release of a mechanism that snaps the petal-simulating elements of the flower to a closed position, whereby the game piece becomes trapped within the flower.

2. Description of the Prior Art

Heretofore, amusement devices or games have been devised, wherein elements are suspended within a playing area by means of a string or chain, and include magnetic means designed either to assist in or make more difficult the engagement of said elements with other game pieces. For example, U.S. Pat. No. 468,274 discloses a magnetic hook suspended by means of a chain, and intended for engagement with an eye on a game piece. Other magnetic games, of course, are well known, requiring skill on the part of the player, involving for example the repositioning of cups (U.S. Pat. No. 2,590,002); of the removal of a game piece by means of wands having magnetic elements on them (U.S. Pat. No. 2,904,336). In somewhat the same vein are patents such as U.S. Pat. Nos. 3,249,357; and 3,312,470, both of which include magnetic elements suspended by flexible members and offering a challenge to the skill of the player.

None of these, however, contains a suggestion for a game wherein the failure of the player to exercise requisite skill in removing counters from a playing area, results in triggering of a mechanism that will instantaneously snap shut a sectional wall in a manner somewhat analogous to that in which insects are trapped by any of the various insectivorous plants, such as the Venus' Fly-Trap, for example.

SUMMARY OF THE INVENTION

In its broadest aspects, the present invention may be briefly summarized as incorporating a playing area ringed by a sectional wall. The sections are normally retracted, and are retained in their retracted or open positions by toggle means movable over a dead center in respect to a rubber band or other resilient, yielding member tending to bias the wall sections to a closed position. When a game piece is suspended within the playing area for the purpose of engaging and removing a plurality of counters, unintentional movement of the game piece too close to a predetermined location causes a magnetic attraction to be set up such as to shift the toggle link mechanism from its wall-section-latching position to a release position, so that the wall sections immediately pivot forward on a base to close over the playing area and thereby trap the game piece inside the playing area.

In a more particular sense, the invention comprises a bee-and-flower game wherein the wall sections are in the form of flower petal simulations, pivotally mounted upon a base structure which is in the simulation of the calyx of the bloom. The removable counters are in the simulation of stamens of the bloom, and are arranged about a trigger element which simulates a pistil and has a magnetic means at its upper end. The game piece has both a magnetic means attractable to the pistil simulation, and hook means engageable with the stamen-simulating counters. If the player is sufficiently skillful, he or she may remove a number of the counters without causing the game piece to be attracted to the pistil simulation. When the game piece, which is in the simulation of a bee, is attracted to the pistil by inadvertent swinging of the game piece too close to the pistil, the natural tendency of the player to pull up on the game piece causes the triggering element to operate the link mechanism back past dead center. As a result, under the force of a rubber band or similar biasing means, the petal simulations are snapped shut to trap the unfortunate bee within the playing area somewhat similarly to the way in which an insect that ventures into a Venus' Fly-Trap is trapped by closure of the petals of the bloom, and is consumed by the plant.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DESCRIPTION OF THE PREFERRED EMBODIMENT

Figure 1:
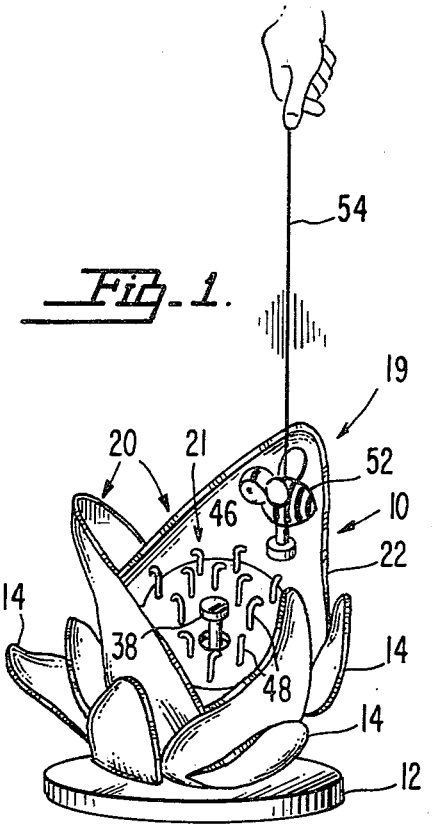
FIG. 1 is a perspective view showing a game according to the present invention, as it appears when in use with the petal-simulating trap elements in open position.

In the illustrated, preferred embodiment of the game comprising the present invention, the amusement device or game has been generally designated 10, and includes a circular, flat base 12, having a stationary, peripheral, upstanding wall comprised of a plurality of stationary wall sections 14 formed as concavo-convex members having inwardly directed flanges secured fixedly to the base by screws 16 or the like (see FIG. 5), and formed in the simulation of calyxes or sepals of a flower.

Integral or otherwise made rigid with the base, and concealed by the stationary wall sections 14, are bearing posts 18. These are arranged in an annular series, in pairs, inwardly from the stationary wall sections, to provide supports on which the sections of a movable wall 19 are pivoted for movement between the full line and chain dotted line positions shown in FIG. 5.

The sections of the movable wall 19 are disposed inwardly from the stationary wall sections 14, and comprise trap elements 20 arranged in an annular series about the center of the base, and formed in the simulation of the petals of the flower. Thus, as shown, the trap elements 20 may be approximately concavo-convex in cross section, while formed as upwardly tapering members, to simulate the flower petals. The trap elements 20 are arranged about a central, normally opened playing area 21. In the playing area 21, a game piece is to be suspended by a player, during the use of the game, and as will be presently shown, the petal-simulating trap elements 20 are adapted to be snapped shut over the game piece in the manner shown in FIG. 2, should the player err in positioning of the game piece within the playing area.

Considering the particular construction of each of the trapping elements 20, it may be noted that each element includes a body 22 which, as previously disclosed herein, tapers upwardly, and is of cupped or inwardly concavo-convex form, with the cupped portion facing inwardly of the flower. Each body 22 is integrally formed with an inwardly directed, flat base plate or flange 24 (see FIGS. 5 and 6), having depending bearing lugs or blocks 26 formed with bearing openings registering with cooperating bearing openings of the posts 18. As may be noted particularly from FIG. 6, the bearing posts 18 of each pair are transversely spaced, in close proximity to the depending bearing lugs 26 of the particular trapping element 20 that is to be pivoted upon said posts 18. To provide for the pivotal mounting of each trap element upon its associated bearing posts, pivot pins 28 are utilized, extending within the bearing openings of the posts 18 and their adjacent, cooperating blocks 26. As a result, each of the trap elements is adapted to pivot or rock upon the base between their retracted, open positions shown in FIGS. 1 and 3, and in full lines in FIG. 5, and their closed or trapping positions shown in chain dotted lines in FIG. 5, and also shown in FIGS. 2 and 6.

Figure 2:
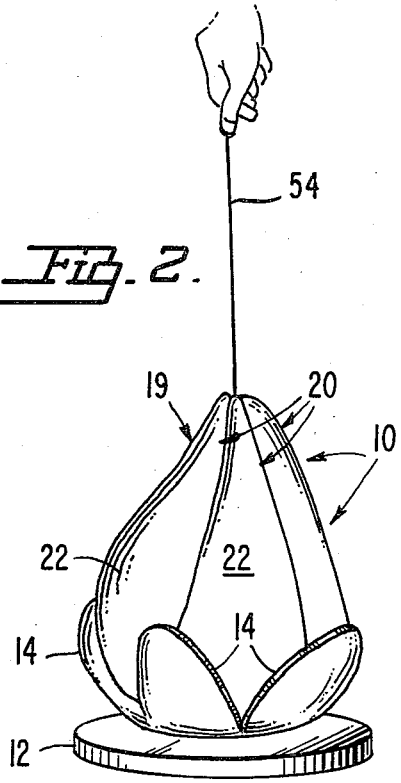
FIG. 2 is a view similar to FIG. 1 in which the trap elements have swung to their closed positions.
Figure 3:
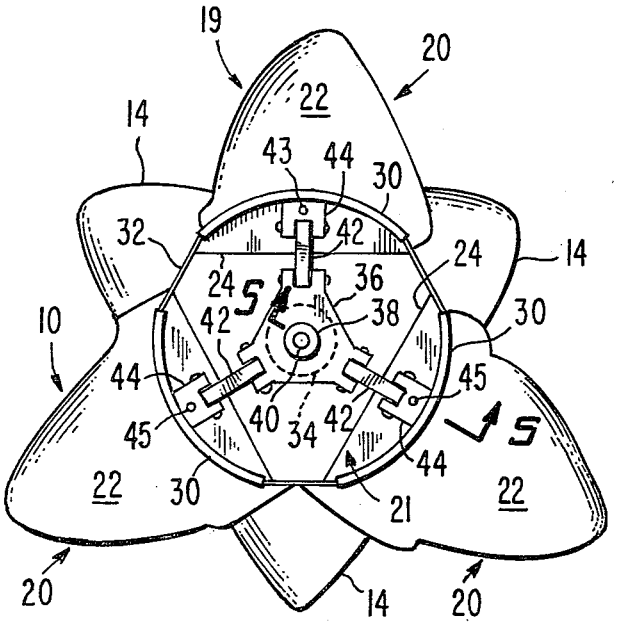
FIG. 3 is an enlarged top plan view of the game with the trap elements in their open positions.

The several trapping elements 20, as previously noted, extend about the playing area 21, and when the trapping elements are in their open positions, the playing area 21 is fully uncovered or exposed, as shown in FIGS. 1 and 3. This is the position of the trapping elements, when the player dangles a game piece in the playing area 21 for the purpose of engaging and withdrawing removable counters disposed within the playing area. When, however, the several trapping elements are rocked to their advanced or closed positions shown in FIG. 2, they close over and completely cover the playing area as shown in FIG. 2, to trap the game piece therein.

Figure 5:
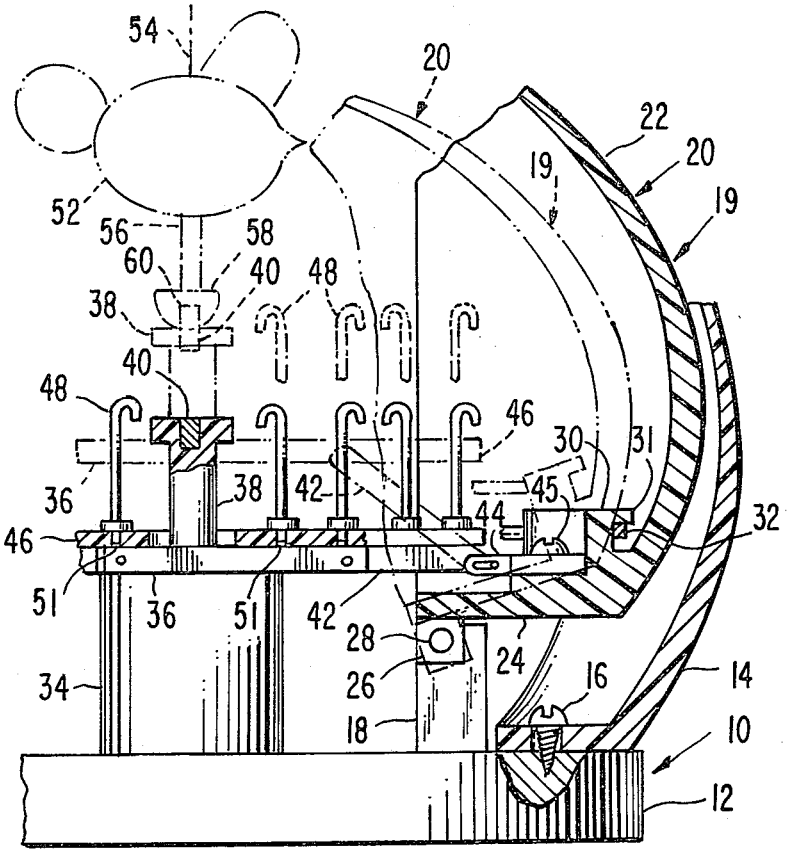
FIG. 5 is an enlarged, fragmentary, vertical sectional view substantially on line 5—5 of FIG. 3, the dotted lines indicating the position of the parts when the trap elements move to their closed, trapping positions.
Figure 6:
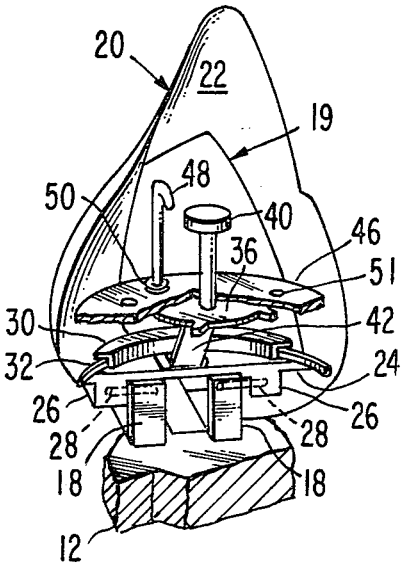
FIG. 6 is a fragmentary perspective view illustrating the interior of the game with the petal-simulating trapping elements, in closed position.

With further reference to the particular construction of each trapping element, it may be noted from FIGS. 5 and 6 that interiorly, each element is formed with an elongated, transversely extending, integral retaining rib 30, having a rearwardly directed lip 31 (see FIG. 5). The ribs of the respective trapping elements extend across a substantial portion of the width of the trapping element, above but in close proximity to the plane of the base plate 24 of each trapping element. As a result, a rubber band 32, extended within the several retaining ribs 30, tends to exert a continuous force on the several trapping elements, tending to bias the same from their full line to their dotted line positions shown in FIG. 5. The use of a rubber band, extended as a continuous resilient, yielding loop about the entire playing area, provides an inexpensive means for biasing the trapping elements simultaneously to their closed, FIG. 2 positions. Alternatively, however, it may be desirable to provide each trapping element with its own associated compression coil spring or, possibly, with a leaf spring. These possible modifications, it is thought, are deemed sufficiently obvious as not to require special illustration herein.

As will be noted, the rubber band 32 exerts its contractile force upon the several trapping elements in a plane above the plane of the pivotal mountings of said elements, thus tending to pull all of the elements together over the playing area whenever they are free to be so moved.

Figure 7:
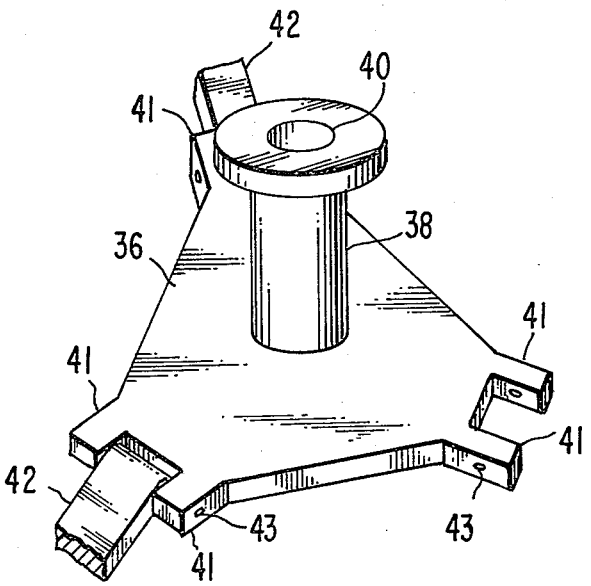
FIG. 7 is a greatly enlarged, fragmentary perspective view of the trigger element and an associated support plate, the links connected thereto being illustrated fragmentarily.

Centrally formed upon the base 12 is an upstanding stop block 34, which may be integral with the base or may alternatively be secured fixedly thereto. The stop block 34 is in supporting relation to, and is adapted to limit downward movement of, a trigger member support plate 36. Plate 36 is illustrated to particular advantage in FIG. 7, and in a preferred embodiment may be approximately triangular in form, assuming that there are three trapping elements. The particular outer configuration of the plate 36 may, however, vary according to the desires of the manufacturer, and it could be circular, square, or any other suitable configuration. In any event, integral or otherwise made rigid with the plate 36, centrally thereof, is an upstanding trigger member 38, which is formed as a simulation of the pistil of a flower, having an enlarged head in which is embedded or otherwise fixedly mounted a magnetic element 40.

At uniformly, angularly spaced intervals about the periphery of the trigger member support plate 36, there are formed pairs of lugs 41 (FIG. 7), in embracing relation to the inner ends of connecting links 42, which are pivotally connected to the lugs through the provision of pivot pins 43. Links 42 extend radially outwardly from the trigger member support plate 36, as shown to best advantage in FIG. 3, and are pivotally connected at their outer ends to connector blocks 44 secured by screws 45 (FIGS. 3 and 5) to the base flanges 24 of the several trapping elements 20.

As a result, when the trigger member 38 is pressed downwardly to the full line position shown in FIG. 5, the downward movement of the support plate 36 with the trigger member is limited by engagement of plate 36 against the top surface of the stop block 34. In these circumstances, the links 42 and the plate 36, and the pivotal connections at the opposite ends of the several links 42, all move into a common plane. As a result, the plate 36 and links will have moved past a dead center in respect to the direction of the force exerted against the several trap elements by the rubber band, tending to swing the trap element to their closed positions. This in effect latches the trap elements in their outwardly swung, retracted, open positions shown in FIGS. 1 and 3, and in full lines in FIG. 5.

Figure 4:
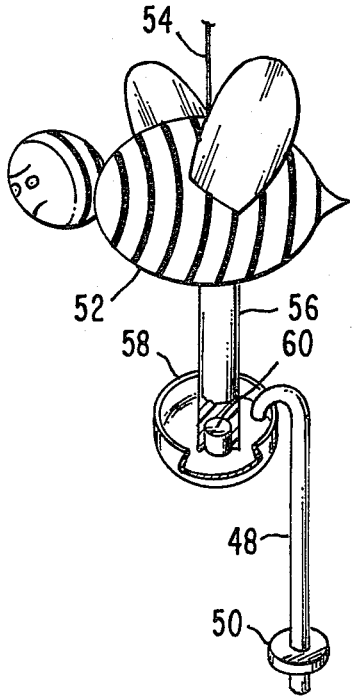
FIG. 4 is a still further enlarged perspective view, portions being broken away, showing the game piece and a game counter engaged thereby.

Removably supported upon the plate 36 is a flat, circular counter support plate 46, supporting an array of upstanding counters 48, each of which is of inverted J shape, that is, each counter is in the form of an upstanding, slender stem or rod simulating the stamen of a flower, with the head portion of each stem having a downwardly turned hook as shown to best advantage in FIGS. 4 and 5.

To provide means for supporting the game counters 48 in their upstanding positions, each of the counters has, adjacent its lower end, a stop collar 50, and formed in the counter support plate 46 are annular rows of openings 51 (see FIG. 5) receiving the lower ends of the game counters. The game counters are loose in the openings, to facilitate their removal during the playing of the game.

A game piece 52, in the preferred, illustrated embodiment, is in the fanciful simulation of a bee, and is adapted to be dangled within the playing area 21 through the provision of a string 54 held by a player as shown in FIGS. 1 and 2. The game piece 52, on its underside, is integral or otherwise made rigid with a depending stem 56, which at its lower end is integral or otherwise rigid with a dished flange of cup member 58, in which is centrally embedded a magnetic element 60.

The purpose of the cup member 58 is to define, at the lower end of the stem 56, a continuous hook-like form adapted to hook under the mating, hook-shaped upper end of a game counter 48 in a manner best shown in FIG. 4. The magnetic element 60, however, opens downwardly, in centered relation to the hook means defined by the cup member 58, and is adapted to be magnetically attracted to the magnetic element 40. One or the other of the elements 40 or 60 can be a permanent magnet, or perhaps both can be magnetic as long as they are of opposite poles and will attract each other. When only one of these elements is a permanent magnet, the other must be of a non-magnetic material attractable to a magnet, as for example, a ferrous material such as iron or steel.

Operation

In use of the game, initially the trigger member 38 is pressed down by a user, to the full line position shown in FIG. 5, whereby to move the links 42 past a dead center in respect to the rubber band 32. The rubber band 32, thus, is placed under tension due to the fact that the trap elements have been swung to their outer positions, but cannot bias the trap elements inwardly because the plate 36 and link 42 are in their dead center positions and prevent, as a result, the rubber band from contracting. It may be noted in this regard, that at one end of each link, the link should have a sliding pivotal connection to the member to which it is connected, and in this instance, the sliding pivotal connection is provided on the connector blocks 44. Said sliding connection could, however, if desired be provided at the inner ends of the links, where they are connected to the plate 36.

In any event, the player dangles the game piece 52 within the playing area 21. The object is to remove as many of the counters 48 as possible, without causing the game piece to be trapped. As a result, the player is required to exercise a certain degree of skill, since the game piece tends to swing back and forth at the lower end of the string, and may swing dangerously close to the center of the playing area, where the magnetic element 40 is located.

Assuming that the player does indeed show sufficient skill to remove all the counters by hooking each one individually and carefully pulling upwardly upon the game piece, the player may be considered as having properly mastered the game. If, however, the player inadvertently causes the game piece 52 to swing over the pistil-simulating trigger member 38, the magnetic elements 40, 60 will be attracted to each other, and as a result, upon upward pull being exerted on the string, the game piece 52 will pull upwardly upon the trigger member 38 as shown in dotted lines in FIG. 5. The upward movement of the trigger member 38 as the player tries to remove the game piece 52 will in turn be translated into an upward movement of the plate 36, which causes the links 42 to be swung upwardly to the dotted line positions shown in FIG. 5. This in turn causes the plate 36 and the links to move back beyond a dead center, freeing the rubber band 32 for contraction. The elements 20 are as a result simultaneously swung inwardly by snap action, as the links and plate move back beyond dead center, and snap shut in the positions shown in FIG. 2, closing over the playing area and trapping the bee 52 inside the flower.

The trapping elements are thereafter manually swung back to their open positions, to permit removal of the bee 52, so that another player can now make an effort to see how many counters he or she may remove before the bee is trapped. The player who removes the most counters or stamens without trapping of the bee is the winner.

The game can of course also be played for solitary amusement, and provides a high degree of interest, as the player seeks to develop sufficient skill to hook each game counter, especially those that are closest to the pistil, without swinging the bee into a position in which it will be attracted to the pistil and will in turn be trapped responsive to release or triggering of the mechanism controlling the rocking of the trapping elements 22 to their closed positions.

While the particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A game comprising:

(a) a base;

(b) a plurality of trap elements supported upon the base for movement between open and closed positions adjacent an area of play;

(c) a game piece adapted to be moved within the playing area by a player;

(d) means for actuating the elements to their closed positions so as to trap the game piece, in response to movement of the game piece to at least one predetermined location within the area of play, the trap elements extending about the playing area and being pivotally mounted on the base for swinging movement between open positions in which they extend upwardly from the base to define a wall structure bounding the playing area, and closed positions in which they converge upwardly from the base to substantially cover and conceal the playing area and trap the game piece therein;

(e) resilient yielding means for biasing the trap elements to the closed positions thereof, said resilient yielding means comprising an endless resiliently contractile loop engaged with the several trap elements and extending with said elements throughout the periphery of the playing area; and (f) triggering means engaging the trap elements and movable in one direction over dead center in respect to the direction in which the loop exerts its force tending to bias the elements to their closed positions.

2. A game as in claim 1 in which said triggering means is disposed in said predetermined location within the playing area.

3. A game as in claim 2 in which the game piece, when moved to said predetermined location, actuates the triggering means in an opposite direction past said dead center so as to release the biasing force of the resiliently contractile loop.

4. A game as in claim 3 in which the game piece and the triggering means include magnetically attracting areas for effecting said movement of the triggering means in said opposite directions.

5. A game as in claim 4 in which the game piece includes a flexible suspending member whereby said game piece may be movably suspended within and moved about the playing area by the player.

6. A game as in claim 5 further including a plurality of game counters removably positioned within the playing area in spaced relation to said triggering means, said counters and game piece including means interengaging on movement of the game piece to locations above the respective counters for removing the counters from the playing area.

7. A game as in claim 6 in which the game piece and the counters include hook-like portions adapted to separably interlock with each other to effect said interengagement of the game piece with the several game counters.

8. A game as in claim 7 in which the game piece has a depending cup member defining the hook-like formation thereof, the counters being of inverted -J- shape so as to be suspendable from the edge of the cup member in the interengaging relationship of the game piece and counters.

9. A game as in claim 8 in which the magnetically attractive member of the game piece is centrally mounted in the cup member.

10. A game according to claims 1, 2, 3, 4, 5, 6, 7, 8 or 9 in which the trap elements are in the simulation of the petals of a flower and said game piece is in the simulation of an insect.

11. A game according to claims 1, 2, 3, 4, 5, 6, 7, 8 or 9 in which the trap elements are in the simulation of the petals of a flower, the game piece is in the simulation of an insect, and the triggering means is centered in the playing area and is in the simulation of a pistil.

12. A game according to claims 6, 7, 8 or 9 in which the trap elements are in the simulation of the several petals of a flower, the game piece is in the simulation of an insect, the triggering means is in the simulation of a pistil centrally disposed in the playing area, and the counters are in the simulation of stamens extending about the pistil.

13. A game comprising:

(a) a base;

(b) a plurality of trap elements pivotally mounted on the base, said elements being formed in the simulation of the petals of a flower and being arranged in a generally annular pattern about a substantially circular playing area, said elements being swingable between retracted positions in which they extend upwardly from the base and leave the playing area uncovered, whereby said flower appears as though in full bloom, said elements being swingable to advanced, closed positions in which they converge upwardly to cover said playing area and offer the appearance of a flower the bloom of which has closed;

(c) resilient yielding means tensioned to bias the trap elements to said advanced positions thereof;

(d) an upstanding trigger member mounted for up-and-down movement centrally within the playing area and formed in the simulation of a pistil;

(e) a series of links connected between the trigger member and the several trap elements, said links being movable past dead center in one direction in respect to the resilient yielding means when the trigger member is shifted downwardly to releasably latch the trap elements in their retracted positions, said links when the trigger member is shifted upwardly being adapted to move past dead center in the opposite direction so as to release the force of the resilient yielding means for biasing of the trap elements thereby to their advanced positions;

(f) a game piece formed in the simulation of an insect and adapted to be suspended within the playing area by a player, said game piece and said trigger member including means adapted to shift the trigger member upwardly if the game piece moves into close proximity to the trigger member and is pulled upwardly by the player, whereby to cause the game piece to be trapped within the playing area by movement of the trap elements to their closed positions; and (g) a plurality of game counters formed in the simulation of the stamens of said flower and removably supported in the playing area about the pistil, said game piece and counters having interengageable means whereby to permit removal of the counters individually, by withdrawal of the game piece from the playing area while keeping the same out of close proximity to the trigger member.

14. A game as in claim 13 in which the counters are in the form of upstanding members having hooked upper ends and the game piece has a cup member formed with a lip interengageable with the upper ends of the counters.

15. A game as in claim 14 in which the trigger member and said cup member have magnetically attractive members for engaging the same with each other on movement of the cup member into close proximity to the trigger member.

* * * * *